US005988022A

United States Patent [19]

Wang

[11] Patent Number: 5,988,022

[45] Date of Patent: Nov. 23, 1999

[54] RATCHET WRENCH

[76] Inventor: Yen-Yu Wang, P.O. Box 2103, Taichung, Taiwan

[21] Appl. No.: 09/108,227

[22] Filed: Jul. 1, 1998

[51] Int. Cl.[6] ..... B25B 13/46

[52] U.S. Cl. ..... 81/60; 81/57.29

[58] Field of Search ..... 81/57.29, 60

[56] References Cited

U.S. PATENT DOCUMENTS 2,764,048 9/1956 Thompson ..... 81/60 X
5,533,427 7/1996 Chow ..... 81/60 X

*Primary Examiner*—James G. Smith

[57] ABSTRACT

A ratchet wrench including a handle and at least one fitting wheel rotatably mounted at one end of the handle. A middle section of outer side of the fitting wheel is formed with multiple annularly arranged teeth. A spiral rod is rotatably connected with two pivot sections of the handle near the fitting wheel. The spiral rod meshes with the teeth of the fitting wheel. One end of the spiral rod abuts against an intermediate member for reducing frictional force between the spiral rod and one of the pivot sections. The other end of the spiral rod is engaged with the other of the pivot sections. The spiral rod can cooperate with the teeth of the fitting wheel by any angle so that the handle of the ratchet wrench can be rotated by any angle without limitation of pitch.

5 Claims, 6 Drawing Sheets

RATCHET WRENCH

BACKGROUND OF THE INVENTION

The present invention relates to a ratchet wrench without limitation of pitch.

FIG. 6 shows an existing ratchet wrench in which a rotatable fitting wheel 82 is mounted on a handle for fitting with a nut. An adjustment plate 83 is used to adjust the rotational direction (idling direction) of the fitting wheel 82. The fitting wheel 82 has multiple teeth 821, while the adjustment plate 83 has only )ne stopper tooth 831. Therefore, an operator must rotate the handle 81 through a specific angle for engaging the stopper tooth 831 with the teeth 821. (For example, in the case that there are 24 teeth 821, the specific angle will be a multiple of 15 degrees.) Therefore, the ratchet wrench is operated under a limitation of pitch. Especially, in a relatively narrow space, the travel and moving range ot the handle 81 are more restricted.

SUMMARY OF THE INVENTION

It is therefore a primary object of the present invention to provide a ratchet wrench in which a spiral rod can cooperate with the teeth of the fitting wheel by any angle, permitting the handle of the ratchet wrench to be rotated by any angle without limitation of pitch.

According to the above object, the ratchet wrench of the present invention includes a handle and at least one fitting wheel rotatably mounted at one end of the handle. The fitting wheel is formed with a central fitting hole. A middle section of outer side of the fitting wheel is formed with multiple annularly arranged teeth. The handle is disposed with two pivot sections on two sides near the fitting wheel. Two ends of a spiral rod are respectively rotatably connected with the pivot sections. The spiral rod has a thread section with a length slightly shorter than a distance between the pivot sections. The spiral rod meshes with the teeth of the fitting wheel. One end of the spiral rod abuts against an intermediate member for reducing frictional force between the spiral rod and one of the pivot sections. The other end of the spiral rod is engaged with the other of the pilot sections.

The present invention can be best understood through the following description and accompanying drawings, wherein:

DETAILED DESCRIPTION OF THE PREFERRED EMBODIMENT

Figure 1:
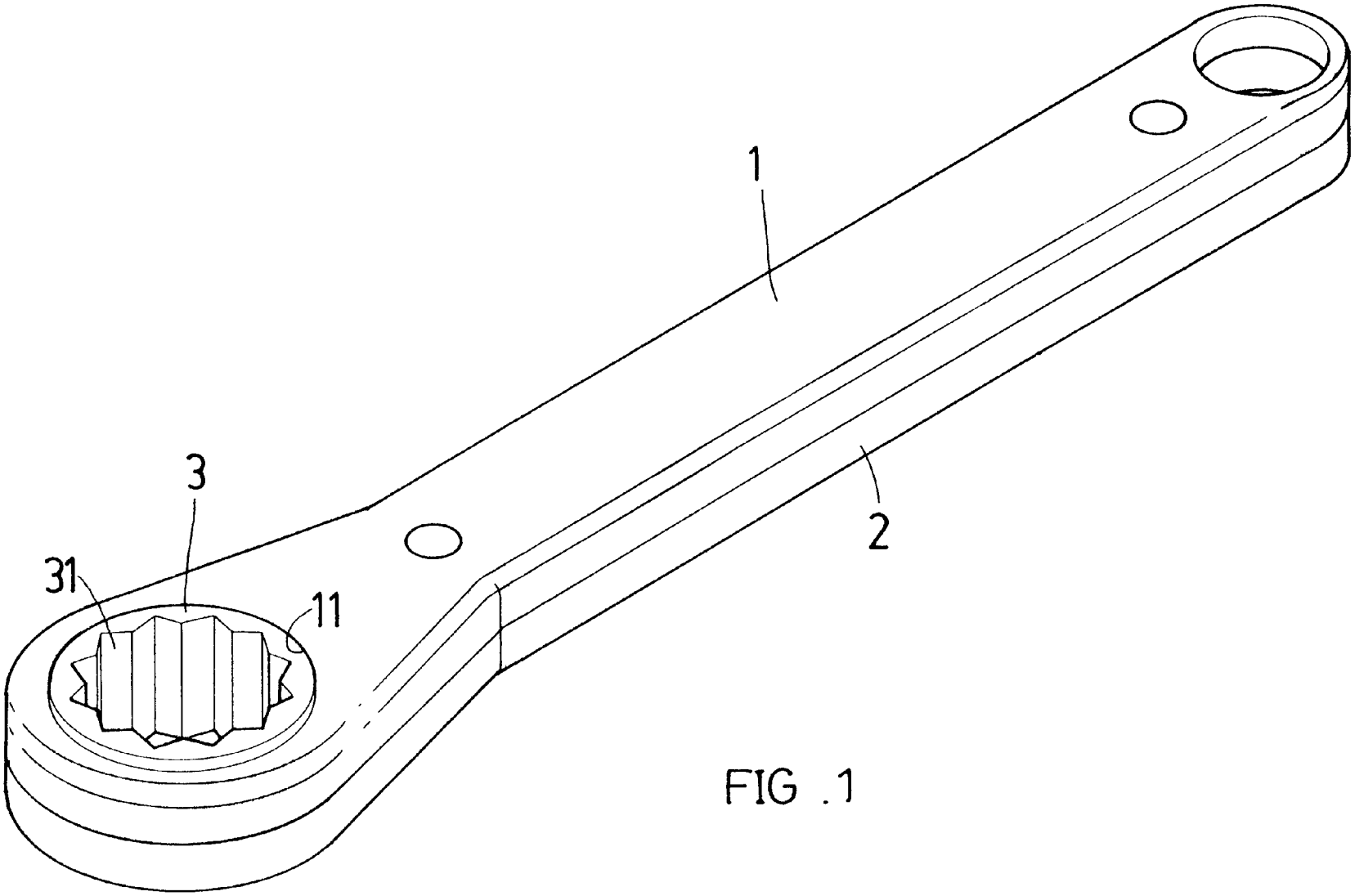
FIG. 1 is a perspective assembled view of the present invention.
Figure 2:
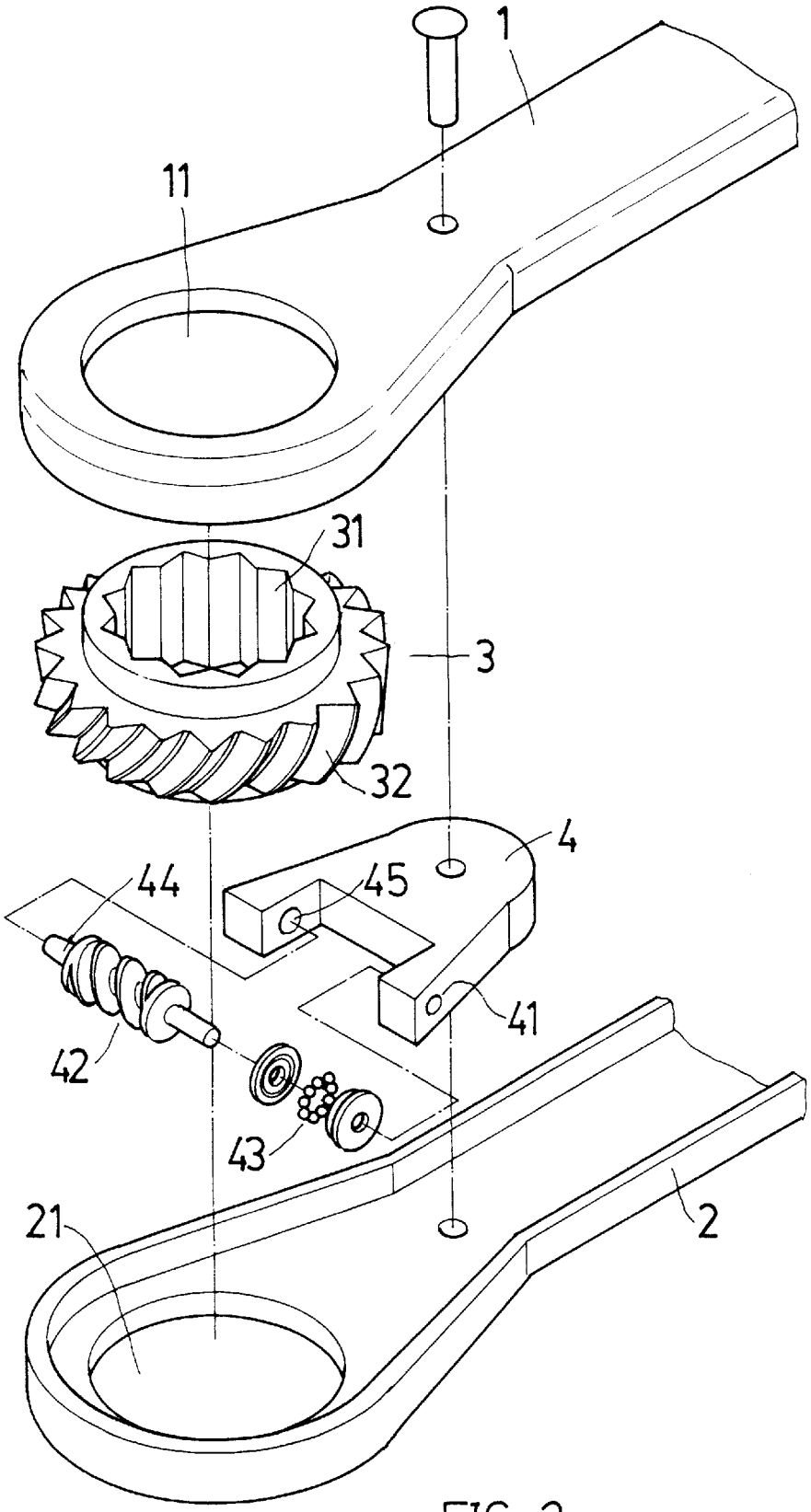
FIG. 2 is a perspective exploded view of the present invention.
Figure 3:
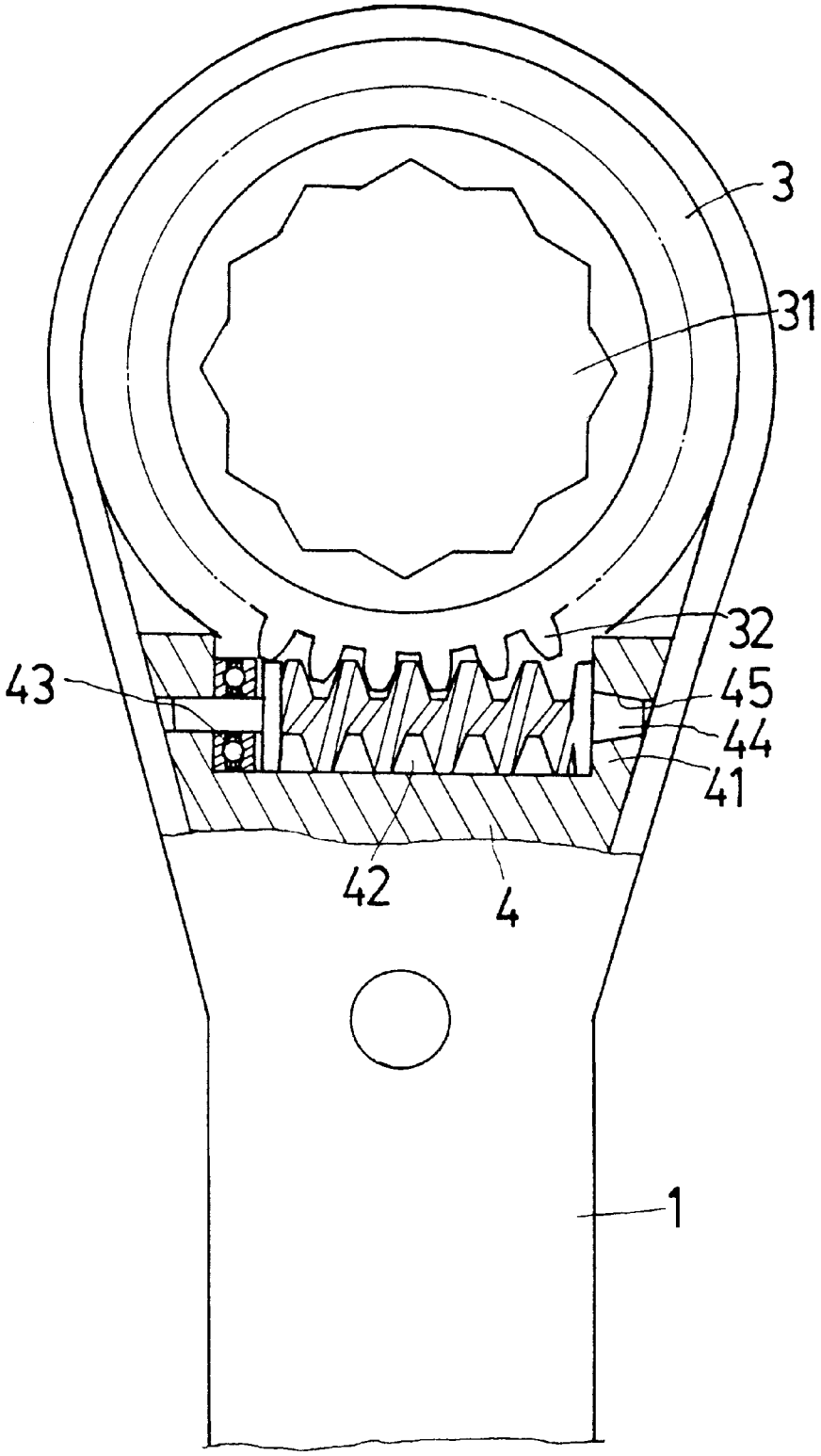
FIG. 3 is a sectional view of the present invention.

Please refer to FIGS. 1 to 5. The present invention includes an upper board and a lower board 1, 2 which have the same profile. Each board is formed with a circular pivot hole 11, 21 at one end. An upper and a lower ends of a fitting wheel 3 are respectively fitted in the two pivot holes 11, 21.

The fitting wheel 3 is formed with a central fitting hole 31 for fitting with a screw head 5 or nut. A middle section of outer side of the fitting wheel 3 is formed with multiple annularly arranged teeth 32 inclined to the axis of the fitting wheel 3 by a certain angle. A pivot seat 4 is sandwiched between the upper and lower boards 1, 2 near the fitting wheel 3. One end of the pivot seat 4 proximal to the pivot holes 11. 21 is formed with two pivot sections 41 on two sides. The pivot sections 41 are respectively pivotally connected with two ends of a spiral rod 42. The spiral rod 42 has a thread section with a length slightly shorter than the distance between the pivot sections 41. The spiral rod 42 meshes with the teeth 32 of the fitting wheel 3. One end of the spiral rod 42 abuts against an intermediate member 43 for reducing the frictional force between the spiral rod 42 and one of the pivot sections 41. According to a preferred embodiment of the present invention, the intermediate member 43 is a thrust bearing. The other end of the spiral rod 42 is formed with a conic section 44 fitted in a conic hole 45 of the other of the pivot sections 41.

Figure 4:
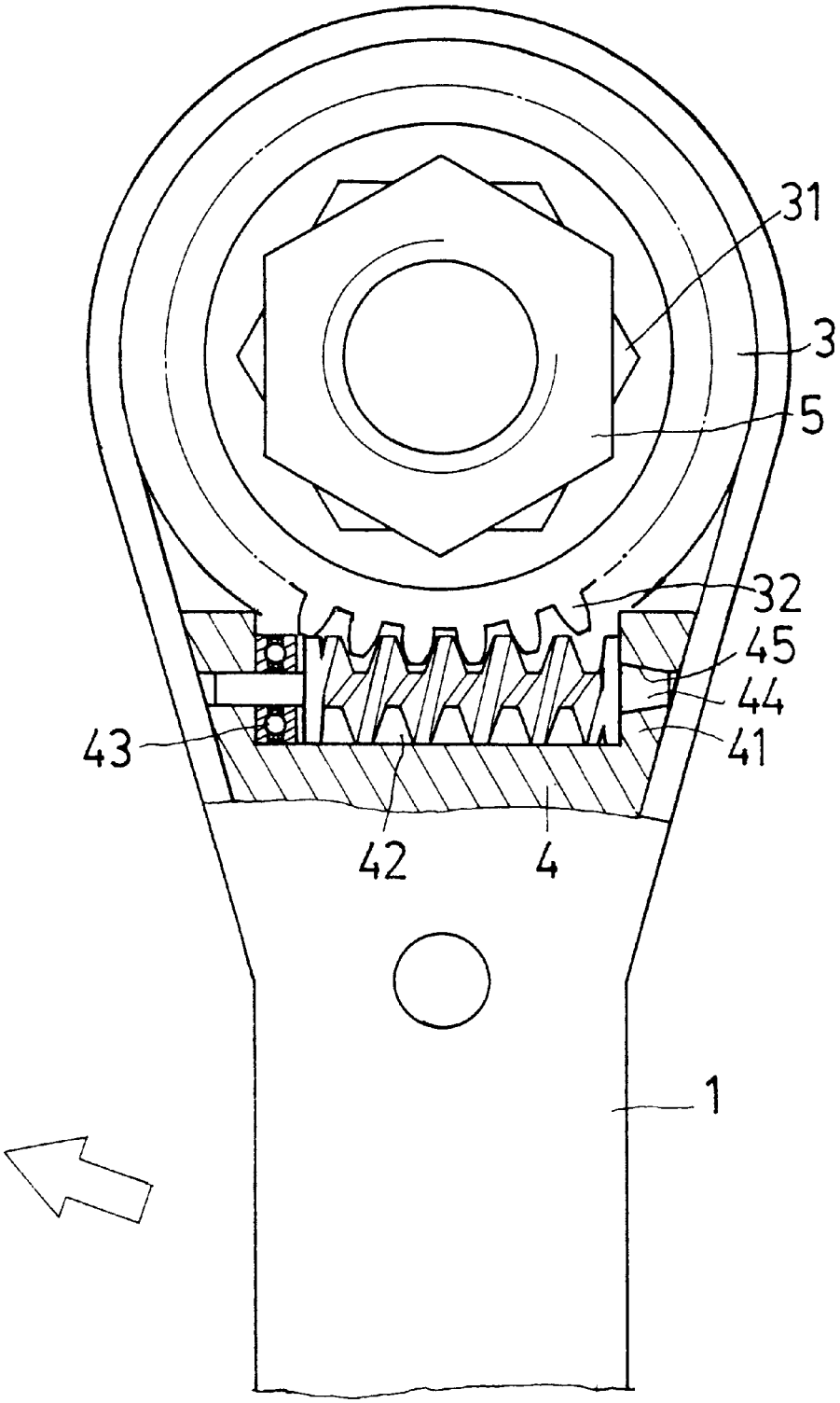
FIG. 4 shows the operation of the present invention in one state.
Figure 5:
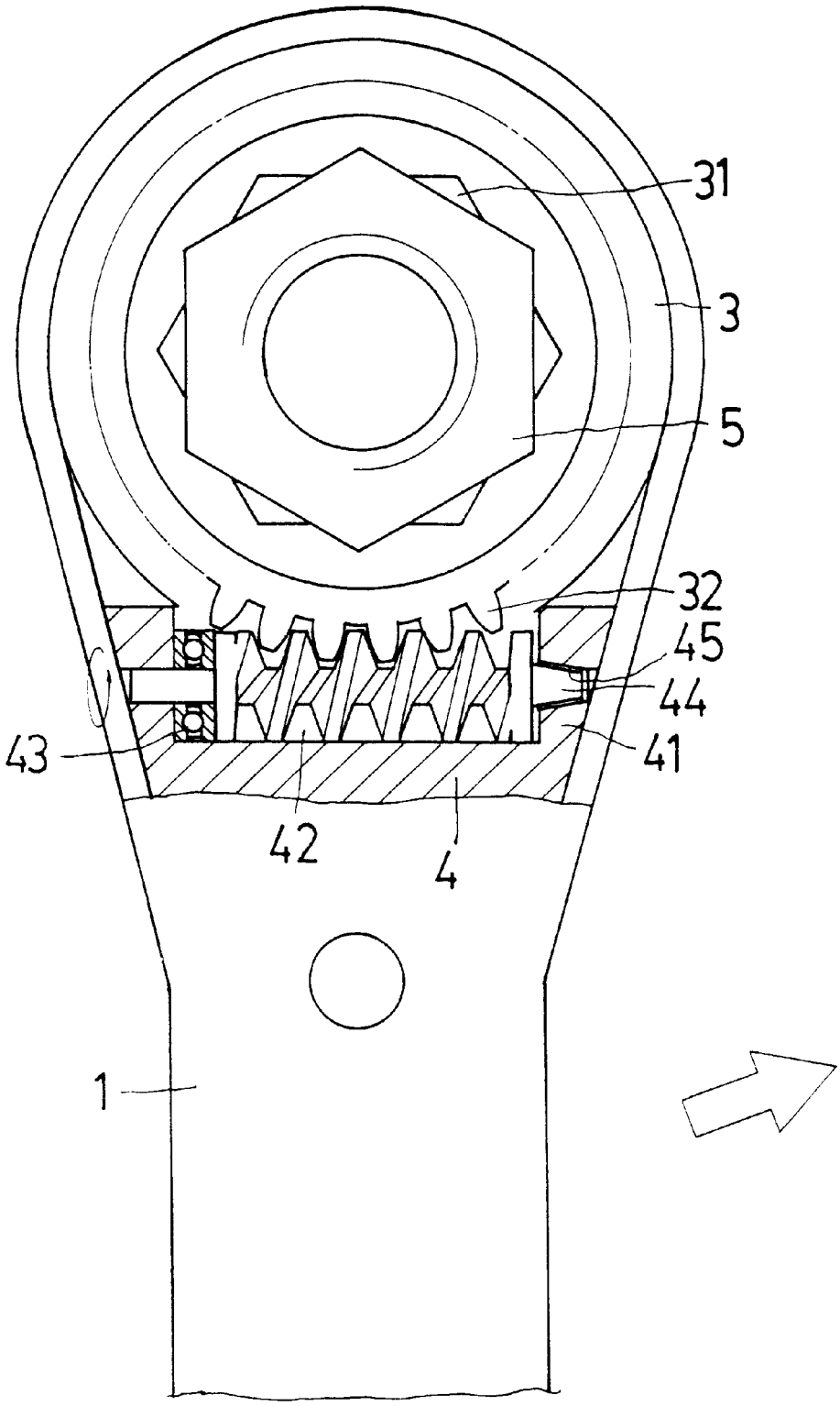
FIG. 5 shows the operation of the present invention in another state.
Figure 6:
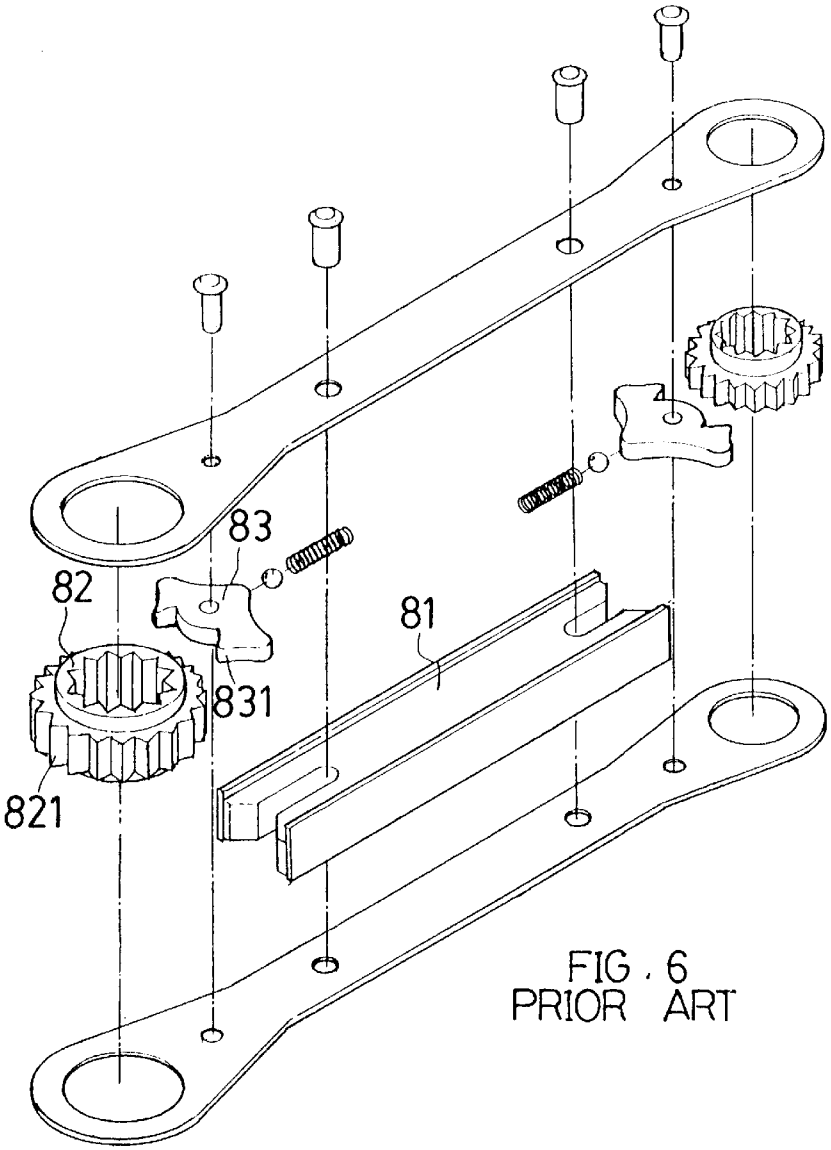
FIG. 6 PRIOR ART
FIG. 6 is a perspective exploded view of a conventional ratchet wrench.

Please refer to FIGS. 4 and 5. In use of the present invention, the tightening or untightening direction is first ascertained. (Generally, the tightening direction is clockwise direction, while the untightening direction is counterclockwise direction) The intermediate member 43 is positioned on left side and then the head 5 of the screw which is preliminarily screwed in the thread hole is fitted into the fitting hole 31. Then the wrench is rotated clockwisely. Because the screw is preliminarily tightened in the thread hole, the teeth 32 of the fitting wheel 3 will exert a resistant force against the spiral rod 42. This resistant force makes the conic section 44 of the spiral rod 42 abut against the inner wall of the conic hole 45. By means of the frictional force between the conic section 44 and the inner wall of the conic hole 45, the spiral rod 42 is uneasy to slide. (That is, the spiral rod 42 is uneasy to rotate.) Therefore, the spiral rod 42 is engaged with the fitting wheel 3 and the force of an operator can be transmitted to the screw head 5 for tightening the screw. In addition, in operation, the hand of the operator will only move within a certain angular range. When the operator reversely rotates the wrench, because the screw has a certain tightness, the teeth 32 of the fitting wheel 3 will exert a clockwise resistant force onto the spiral rod 42. This makes the conic section 44 slightly separate from the inner wall of the conic hole 45. The left end of the thread section of the spiral rod 42 abuts against the intermediate member 43 and the intermediate member 43 cannot provide circumferential stopping effect so that the spiral rod 42 is guided by the teeth 32 of the fitting wheel 3 to rotate. The rotational movement ot the spiral rod 42 makes it reversely engaged with the teeth 32 so that the spiral rod 42 no more provides stopping effect. Accordingly, the handle formed by the upper and lower boards 1, 2 and the pivot seat 4 can be idled. Therefore, the operator can easily operate the wrench within the moving range of his hand Reversely, when it is desired to untighten the screw, the wrench is reversed to fit the fitting hole 31 around the screw head 5 so as to convert the tightening direction into untightening direction.

It should be noted that the spiral rod 42 can cooperate with the teeth 32 of the fitting wheel 3 by any angle so that the wrench of the present invention can be conveniently operated by any angle even in a narrow space without limitation of pitch.

It is to be understood that the above description and drawings are only used for illustrating one embodiment of the present invention, not intended to limit the scope thereof. Any variation and derivation from the above description and drawings should be included in the scope of the present invention.

What is claimed is:

1. A ratchet wrench comprising a handle and one fitting wheel mounted at one end of the handle, the fitting wheel being formed with a central fitting hole, a middle section of an outer side of the fitting wheel being formed with multiple annularly arranged teeth, the handle having two pivot sections on two sides near the fitting wheel, the pivot sections being respectively pivotally connected with two ends of a spiral rod, the spiral rod having a thread section with a length slightly shorter than a distance between the pivot sections, the spiral rod meshing with the teeth of the fitting wheel, one end of the spiral rod abutting against an intermediate member for reducing frictional force between the spiral rod and one of the pivot sections, the other end of the spiral rod being engaged with the other of the pivot sections.

2. A ratchet wrench as claimed in claim 1, wherein the handle is composed of an upper board and a lower board which have the same profile, each of the upper and lower boards being formed with a circular pivot hole at one end, an upper and a lower ends of the fitting wheel being respectively fitted in the two pivot holes, a pivot seat being sandwiched between the upper and lower boards near the fitting wheel.

3. A ratchet wrench as claimed in claim 1, wherein the other end of the spiral rod is formed with a conic section and the other of the pivot sections is formed with a conic hole in which the conic section is fitted.

4. A ratchet wrench as claimed in claim 1, wherein the intermediate member is a thrust bearing.

5. A ratchet wrench as claimed in claim 1, wherein the teeth of the fitting wheel are inclined to an axis of the fitting wheel by a certain angle.

* * * * *